United States Patent [19]

Olivieri

[11] Patent Number: 4,670,946

[45] Date of Patent: Jun. 9, 1987

[54] BINDING DEVICE WITH ARTICULATED COMPONENTS, PARTICULARLY FOR USE WITH SPORT IMPLEMENTS

[75] Inventor: Oliviero Olivieri, Montebelluna, Italy

[73] Assignee: Icaro Olivieri & C. S.p.A., Montebelluna, Italy

[21] Appl. No.: 870,974

[22] Filed: Jun. 5, 1986

[30] Foreign Application Priority Data

Sep. 6, 1985 [IT] Italy ..... 22943/85[U]

[51] Int. Cl.[4] ..... A43C 11/14

[52] U.S. Cl. ..... 24/71 SK; 24/68 A; 24/71 ST; 36/50

[58] Field of Search ..... 24/71 SK, 71 ST, 71 R, 24/68 SK, 68 A, 70 SK, 70 R, 69 SK; 21/50

[56] References Cited

U.S. PATENT DOCUMENTS

| | | | |
|---|---|---|---|
| 4,115,905 | 9/1978 | Seidel | 36/50 X |
| 4,387,517 | 6/1983 | Annovi | 24/71 SK X |
| 4,546,521 | 10/1985 | Ribarits | 24/70 SK |

*Primary Examiner*—Philip C. Kannan

*Attorney, Agent, or Firm*—Fitzpatrick, Cella, Harper & Scinto

[57] ABSTRACT

In a binding device comprising a serrated strap engaged through a leader of an assembly for adjusting the binding tension, the strap can be locked by tightening within the leader with the intermediary of a wedge mounted movably in the leader itself.

8 Claims, 3 Drawing Figures

Figure 1:
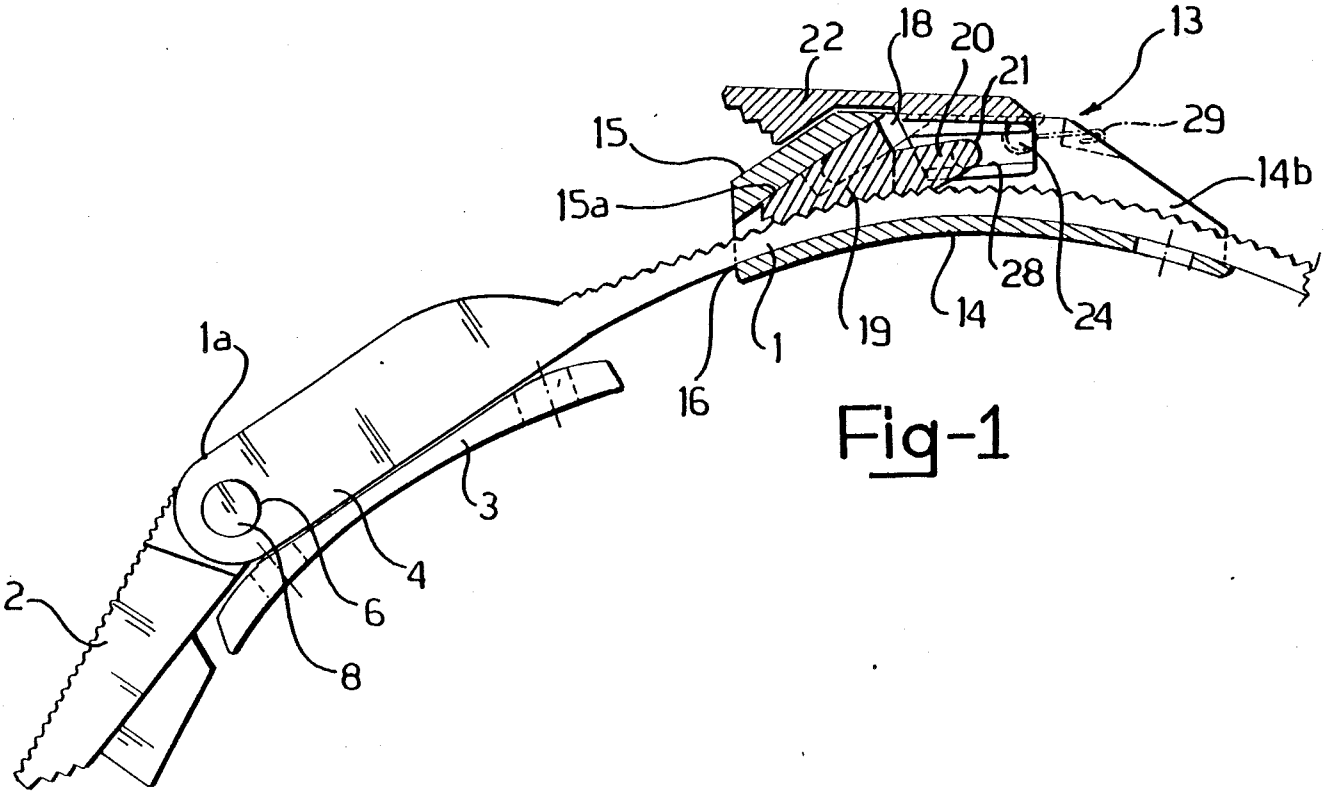

22
29
23
22a
21
19a
19b
19c
19
26
14b
18
15
25
14
17
1
14a
16
5
4
7
6
9a
2b
9
2a
10
8
12
2
3
11

BINDING DEVICE WITH ARTICULATED COMPONENTS, PARTICULARLY FOR USE WITH SPORT IMPLEMENTS

DESCRIPTION

This invention relates to a binding device with articulated components, particularly but not exclusively useful with such sport implements as ski boots, ice hockey boots, roller skates, and the like.

More specifically, the invention concerns a binding device of the type wherein a serrated strap is connected, with one end, to a tensioning assembly and is secured, with the other end, releasably to an adjusting assembly.

The tensioning assembly generally comprises a second class lever pivoted to a base of appropriate shape and size for attachment to a sport implement, such as the shell of a ski boot, and the adjusting assembly generally comprises a respective base defining a leader for the serrated strap and carrying a pawl or equivalent locking means adapted to engage with the strap serration teeth under the bias force of a suitable spring, said pawl being formed on a lever pivoted to said base and operable by the user of the sport implement.

A first, well recognized disadvantage of the binding devices of the type considered arises from the likelihood of the binding tension relaxing to a greater or lesser extent during the sport practice, owing to inadvertent striking of the pawl control lever causing disengagement of the pawl from the strap serration.

A second disadvantage is that ice formation between the pawl control lever and the ski boot shell may hinder operation of said lever, and accordingly, release of the binding at the end of a run.

An additional, not negligible disadvantage resides in the elaborate and expensive construction of such a device, especially as relates to making the various elements which comprise it and their assembly. In fact, in the making of the many pivotal connections for such components, it is necessary to perform appropriate drilling thereof, align the drilled hole axially to engage them simultaneously with a pivot pin, and to upset the pivot pin ends to confirm the resulting articulation. All these operations require the availability of suitable equipment, a comparatively long time, and labor.

It is the primary object of this invention to provide a binding device as indicated, which has such constructional and operating features as to overcome all of the disadvantages listed above in connection with prior art approaches.

This and other objects, to become apparent hereinafter, are achieved by a binding device with articulated components, particularly for use with sport implements such as ski boots, roller skates, and the like, of a type wherein a serrated strap is connected, at one end, to a tensioning assembly and is secured, at the other end, releasably to an adjusting assembly comprising a base effectively defining a leader for said serrated strap, which device is characterized in that it comprises a wall in said leader in juxtaposed relationship with said base and sloping toward said base and tensioning assembly, a wedge guided movingly across through said leader in substantial contact with said sloping wall, and a lever pivoted to said base and linked operatively to said wedge and being displaceable angularly against the bias of a spring means to drive said wedge through said leader.

Figure 2:
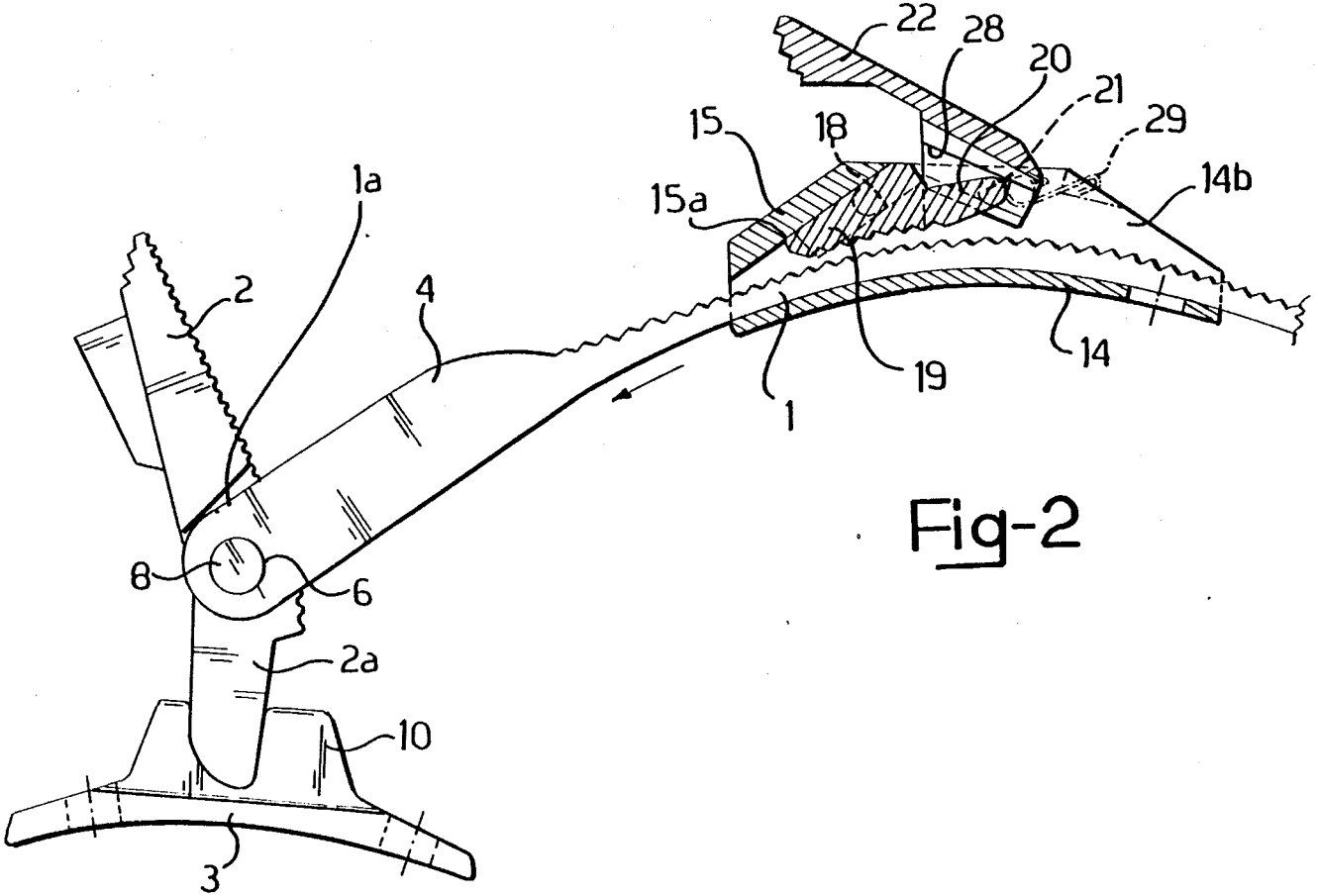
Figure 3:
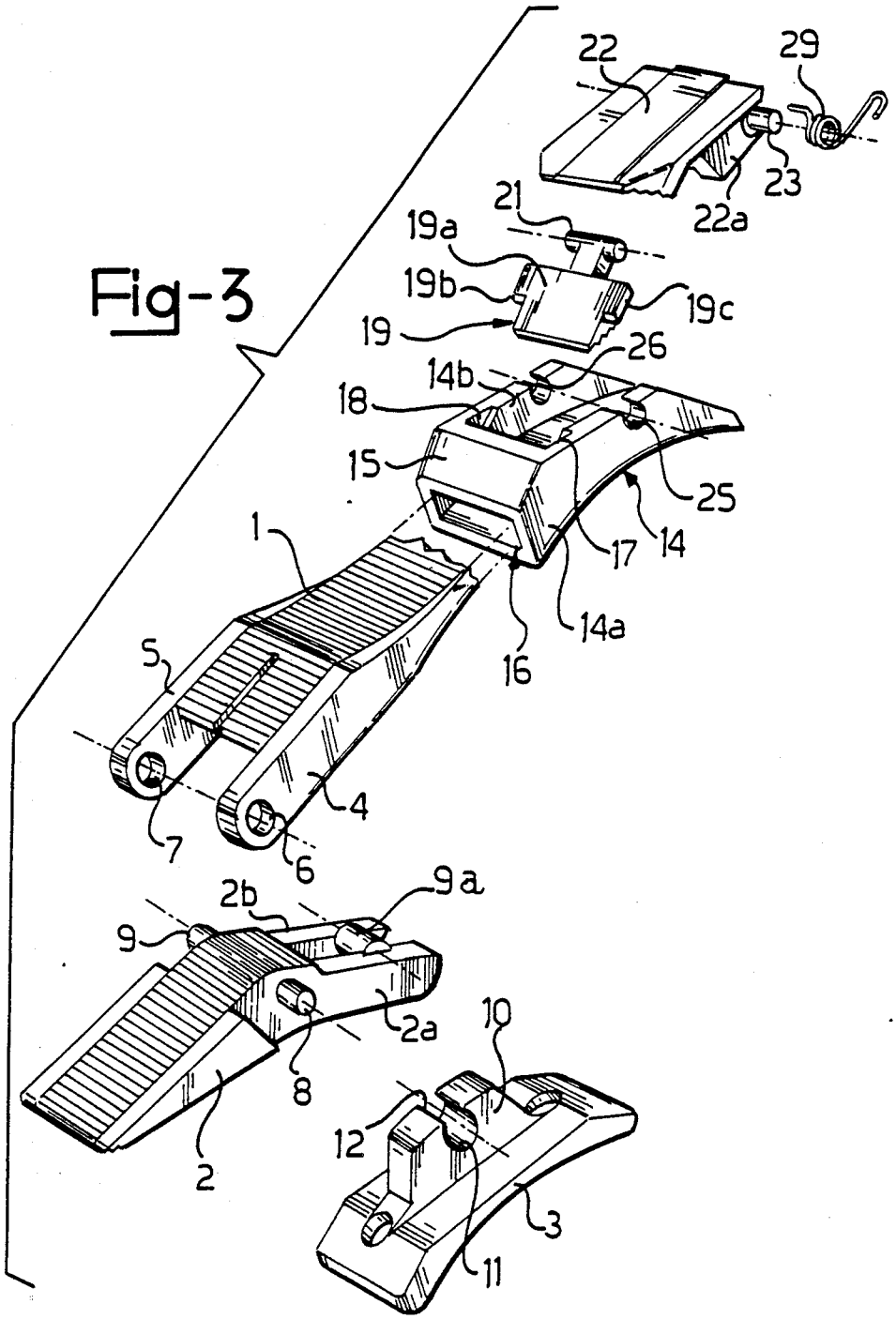

Further features and advantages will be more clearly apparent from the following detailed description of a binding device according to the invention, given herein with reference to the accompanying illustrative and not limitative drawings, where:

FIGS. 1 and 2 show diagramatically in longitudinal section a binding device according to the invention, at two operative settings thereof; and FIG. 3 is an exploded view showing in perspective the same device as in the preceding Figures.

With reference to the cited drawing figures, a binding device according to the invention comprises a serrated strap 1, connected at one end to a second class lever 2 pivoted on a base 3 which is adapted to be attached, by means known per se and not shown, to a sporting implement, e.g. the shell of a ski boot.

More specifically and in accordance with a feature of this invention, the strap 1 would be provided, at one end 1*a* thereof, with a pair of parallel lugs 4,5 extending lengthwise to said strap 1 and jutting therefrom. Said lugs 4,5 are through-penetrated by respective holes 6,7 adapted for engagement by pivot pins 8,9 of unitary construction and located at a selected intermediate position on said lever 2. Coupling of the pins 8 and 9 in the holes 6 and 7 is accomplished by force fitting and elastic spreading of the lugs 4,5.

The lever 2 (FIG. 3) has a forked resisting arm the prongs 2*a*,2*b* whereof are stiffened mutually by a cylindrical crosspiece 9*a*, formed integrally at the ends thereof. This cylindrical cross-piece forms the pivot for the lever 2 on the base 3. In particular, to accomplish this, the base 3 would be formed longitudinally with a raised portion 10 through—penetrated by a hole 11 forming a seat for receiving the aforesaid pivot pin 9*a*. The seat 11 has a cross-sectional configuration that does not complete a loop owing to the provision of a slit 12, formed in the raised portion 10 lengthwise to the hole 11. The coupling of the pin 9*a* with its corresponding seat 11 is of the snap-action type.

The device of this invention further comprises an adjusting assembly, comprehensively designated 13 in FIG. 1.

This adjusting assembly comprises, in turn, a base 14 which it designed and constructed for attachment, in a manner known per se, to the shell of a ski boot. This base 14 is constrained longitudinally by two lateral sides 14*a*,14*b* and defines a leader 15 for the serrated strap 1. In particular, (FIGS. 1 and 2) said leader has an inner wall 15*a* juxtaposed to the base 14 which is inclined toward the base and a strap inlet opening 16 (or entry of the leader 1), which has a slightly larger breadth than the overall thickness of the strap.

In the sections of the walls 14*a*,14*b* that extend within the leader 15, there are formed straight grooves 17,18, respectively, which extend parallel to the inner wall 15*a* of said leader. These grooves 17,18 form sliding guides for a wedge 19, which is provided for that purpose with a pair of side fins 19*b*,19*c* (FIG. 3).

Thus, the wedge 19 is guided movingly across the leader 15 and through it, and has a wall 19*a* in substantial contact with the sloping wall 15*a* of said leader.

The wedge 19 is provided with a tang 20 provided, in turn, with a pin 21 at its free end, whereby it takes a T-like shape. The pin 21, tang 20, and wedge 19 with its fins 19*b* and 19*c* are a unitary construction obtained, for example and preferably, by a molding process from a suitable plastic material.

Concurrently with this molding operation, the wedge 19 is provided with a serrated wall adapted to engage with the serration on the strap 1.

For operation of the wedge 19, the inventive device is provided with a second class lever 22 pivoted to the walls 14*a*,14*b* of the base 14. In particular, the lever 22 would be provided, to accomplish this, with two pins or trunnions 23,24 at one of its ends, which jut out at right angles and are adapted to snap-action engage with respective seats 25,26 formed in the aforesaid walls 14*a*,14*b*.

Again in accordance with the previously mentioned feature of this invention, the pins or trunnions 23,24, just like the seats 25,26 whereinto they snap, would be formed integrally with the lever 22 and the base 14, respectively.

This lever 22 is of a type formed laterally with a pair of opposed lateral sides 22*a*,22*b*, which are formed longitudinally and internally with respective grooves 27,28 (in the drawing only the groove 28 is shown). In these grooves, there are guided slidingly and rotatably the opposed ends of the pin 21 and wedge 19.

A spring 29 has one end engaged with the base 14 and the other end with the pivot pin 24 for the lever 22, to resist angular displacements around the respective pivot.

After tightening on the strap just described, it is the pull itself applied to the strap which locks it within the leader 15 by the very presence of the wedge 19 movable in said leader. The higher the pull applied to the strap in the release direction thereof the higher becomes the force locking it within the leader 15.

When the binding tension is to be relaxed, it will be sufficient to act on the lever 22 in the direction shown in FIG. 2. As a consequence of the lever 22 to wedge 19 coupling, the latter is released from the previously established engagement, thus freeing the serrated strap 1.

In addition to the technical advantage of providing a highly reliable binding which is easily adjusted, the inventive device affords the significant advantage that it is inexpensive to manufacture, especially as regards the assembling operations of its various parts. This advantage is attained also by virtue of the expedient adopted in forming the articulated couplings between the various component parts of the device: in fact, all the pins and their respective seats are formed integrally with their respective parts and their mutual fit is of the snap-action type.

I claim:

1. A binding device with articulated components, particularly for use with sport implements such as ski boots, roller skates, and the like, of a type wherein a serrated strap is connected, at one end, to a tensioning assembly and is secured, at the other end, releasably to an adjusting assembly comprising a base effectively defining a leader for said serrated strap, the device being characterized in that it comprises a wall in said leader in juxtaposed relationship with said base and sloping toward said base and tensioning assembly, a wedge guided movingly across and through said leader in substantial contact with said sloping wall, and a lever pivoted to said base and linked operatively to said wedge and being displaceable angularly against the bias of a spring means to drive said wedge through said leader

2. A device according to claim 1, characterized in that said wedge is formed laterally with two fins engaged slidingly within straight guiding grooves formed in said leader and extending parallel to said sloping wall

3. A device according to claim 1, characterized in that said wedge is provided with a tang supporting, at the free end thereof, a pin rotatably and slidingly engaged in straight guiding grooves formed in said lever.

4. A device according to claim 1, characterized in that said tensioning assembly comprises a second lever provided, at one end thereof, with a pin engaged rotatably in a seat formed in a second base, to form a pivot for said second lever, said pin and said seat being formed integrally with said second lever and said second base, respectively.

5. A device according to claim 4, characterized in that said pin is snap-fitted into said seat.

6. A device according to claim 1, characterized in that said strap has one end configured essentially as a fork with two parallel lugs having free ends through-penetrated by respective holes, and being engaged rotatably with corresponding pins formed in a lever of said tensioning assembly.

7. A binding device according to claim 6, characterized in that said pins are formed integrally with said lever of said tensioning assembly and snap-fit rotatably in said holes in said strap.

8. A binding device according to claim 1, characterized in that said lever is a second class lever and provided at one end with a pair of pins formed integrally therewith and snap-action engaged in respective seats formed in said base in combination wherewith they form a pivot for said lever.

* * * * *

UNITED STATES PATENT AND TRADEMARK OFFICE

CERTIFICATE OF CORRECTION

PATENT NO. : 4,670,946

DATED : June 9, 1987

INVENTOR(S) : Oliviero Olivieri

It is certified that error appears in the above-identified patent and that said Letters Patent is hereby corrected as shown below:

Column 1, line 41, "hole" to read -- holes --;
Column 2, line 6, "diagramatically" to read -- diagrammatically --;
Column 2, line 33, "through——penetrated" to read -- through-penetrated --;
Column 2, line 44, "it" to read -- is --;
Column 4, line 16, "leader" to read -- leader. --;
Column 4, line 20, "wall" to read -- wall. --.

Signed and Sealed this

Seventeenth Day of November, 1987

*Attest:*

*Attesting Officer*

DONALD J. QUIGG

*Commissioner of Patents and Trademarks*